US009291036B2

(12) United States Patent
Baugh

(10) Patent No.: US 9,291,036 B2
(45) Date of Patent: Mar. 22, 2016

(54) METHOD FOR INCREASING SUBSEA ACCUMULATOR VOLUME

(75) Inventor: Benton Frederick Baugh, Houston, TX (US)

(73) Assignee: Reel Power Licensing Corp., Oklahoma City, OK (US)

( * ) Notice: Subject to any disclaimer, the term of this patent is extended or adjusted under 35 U.S.C. 154(b) by 1112 days.

(21) Appl. No.: 13/134,277

(22) Filed: Jun. 6, 2011

(65) Prior Publication Data

US 2012/0305258 A1 Dec. 6, 2012

(51) Int. Cl.
*E21B 43/01* (2006.01)
*E21B 33/064* (2006.01)

(52) U.S. Cl.
CPC ..... *E21B 43/01* (2013.01); *E21B 33/064* (2013.01)

(58) Field of Classification Search
CPC ..... E21B 29/08; E21B 33/06; E21B 34/14; E21B 43/12
USPC ..... 166/344, 345, 351, 361, 363, 368; 137/315.02; 251/1.1, 1.2, 1.3; 417/2, 417/375, 379
See application file for complete search history.

(56) References Cited

U.S. PATENT DOCUMENTS 2,552,901 A * 5/1951 Miller ..... 166/302
3,090,437 A * 5/1963 Geer ..... 285/27
3,163,222 A * 12/1964 Foster et al. ..... 166/344
3,163,224 A * 12/1964 Foster ..... 166/345
3,207,221 A * 9/1965 Cochran et al. ..... 166/85.4
3,215,203 A * 11/1965 Sizer ..... 166/77.4
3,282,336 A * 11/1966 Wakefield, Jr. ..... 166/351
3,308,881 A * 3/1967 Chan et al. ..... 166/340
3,318,377 A * 5/1967 Otteman ..... 166/367
3,338,302 A * 8/1967 Hubby ..... 166/351
3,396,789 A * 8/1968 Dean ..... 166/351
3,405,387 A * 10/1968 Koomey et al. ..... 367/133
3,474,857 A * 10/1969 Newman et al. ..... 166/368
3,496,999 A * 2/1970 Rowley ..... 166/363
3,592,263 A * 7/1971 Nelson ..... 166/356
3,827,239 A * 8/1974 Ulrich, Jr. ..... 60/420
3,834,460 A * 9/1974 Brun et al. ..... 166/341
4,290,735 A * 9/1981 Sulko ..... 417/2
4,337,829 A * 7/1982 Banzoli et al. ..... 166/366
4,378,848 A * 4/1983 Milberger ..... 166/351
4,413,642 A * 11/1983 Smith et al. ..... 137/14
4,461,354 A * 7/1984 Buras et al. ..... 166/343
4,506,735 A * 3/1985 Chaudot ..... 166/357
4,688,633 A * 8/1987 Barkley ..... 166/341
4,955,195 A * 9/1990 Jones et al. ..... 60/405
5,088,558 A * 2/1992 Mohn ..... 166/339
5,122,036 A * 6/1992 Dickes et al. ..... 417/222.1
5,145,324 A * 9/1992 Dickes et al. ..... 417/222.1
5,527,156 A * 6/1996 Song ..... 417/2

(Continued)

*Primary Examiner* — Matthew Buck
*Assistant Examiner* — Edwin Toledo-Duran
(74) *Attorney, Agent, or Firm* — Martin G. Ozinga; Phillips Murrah PC

(57) ABSTRACT

In a subsea system where subsea devices are operated using a pressurized fluid from one or more accumulators, the method of providing flow of pressurized fluid to operate a device which is greater than the flow from an accumulator providing the flow, comprising discharging the accumulator to drive one or more motors, driving one or more pumps by the one or more motors, the one or more pumps having a larger displacement than the one or more motors such that the one or more pump outputs a greater volume of fluid than the motor consumes, and delivering the output of the one or more pumps to operated the subsea device.

4 Claims, 8 Drawing Sheets

(56) References Cited

U.S. PATENT DOCUMENTS

| | | | | |
|---|---|---|---|---|
| 6,318,482 | B1 * | 11/2001 | Fidtje | 175/318 |
| 6,343,654 | B1 * | 2/2002 | Brammer | 166/338 |
| 6,435,279 | B1 * | 8/2002 | Howe et al. | 166/336 |
| 6,588,500 | B2 * | 7/2003 | Lewis | 166/61 |
| 6,609,572 | B1 * | 8/2003 | Andersen et al. | 166/345 |
| 6,814,140 | B2 * | 11/2004 | Robichaux | 166/77.4 |
| 7,096,955 | B2 * | 8/2006 | Zhang et al. | 166/338 |
| 7,111,687 | B2 * | 9/2006 | Donald et al. | 166/368 |
| 7,374,146 | B2 * | 5/2008 | Whitby et al. | 251/1.3 |
| 7,387,166 | B2 * | 6/2008 | Bartlett | 166/335 |
| 7,559,523 | B2 * | 7/2009 | Whitby et al. | 251/1.3 |
| 7,565,932 | B2 * | 7/2009 | Lawson | 166/344 |
| 7,934,376 | B2 * | 5/2011 | Biester | 60/405 |
| 7,934,562 | B2 * | 5/2011 | Grimseth et al. | 166/368 |
| 7,963,110 | B2 * | 6/2011 | Bollinger et al. | 60/410 |
| 7,992,643 | B2 * | 8/2011 | Donald et al. | 166/339 |
| 8,297,361 | B1 * | 10/2012 | Root | 166/364 |
| 8,322,427 | B2 * | 12/2012 | Inderberg et al. | 166/336 |
| 8,430,168 | B2 * | 4/2013 | Goodall et al. | 166/336 |
| 8,490,705 | B2 * | 7/2013 | Curtiss, III | 166/368 |
| 8,616,861 | B2 * | 12/2013 | Weaver et al. | 417/379 |
| 8,622,139 | B2 * | 1/2014 | Herbel et al. | 166/363 |
| 8,651,190 | B2 * | 2/2014 | Dietz | 166/368 |
| 2003/0051881 | A1 * | 3/2003 | Vinegar et al. | 166/374 |
| 2003/0150619 | A1 * | 8/2003 | Meaders | 166/360 |
| 2003/0178200 | A1 * | 9/2003 | Fox et al. | 166/341 |
| 2005/0196288 | A1 * | 9/2005 | Cherney | 417/199.1 |
| 2006/0102357 | A1 * | 5/2006 | Williams | 166/363 |
| 2007/0187110 | A1 * | 8/2007 | Lima Goncalves et al. | 166/368 |
| 2008/0210500 | A1 * | 9/2008 | Walker | 188/151 R |
| 2008/0264646 | A1 * | 10/2008 | Sten-Halvorsen et al. | 166/360 |
| 2008/0296025 | A1 * | 12/2008 | Inderberg et al. | 166/337 |
| 2009/0127925 | A1 * | 5/2009 | Borgemenke et al. | 303/11 |
| 2010/0300679 | A1 * | 12/2010 | Lorimer et al. | 166/105 |
| 2010/0307768 | A1 * | 12/2010 | Bell | 166/382 |
| 2011/0192610 | A1 * | 8/2011 | Machin et al. | 166/344 |
| 2012/0006556 | A1 * | 1/2012 | McHugh et al. | 166/344 |
| 2012/0117970 | A1 * | 5/2012 | Ostlund et al. | 60/660 |
| 2012/0175125 | A1 * | 7/2012 | Krohn et al. | 166/344 |
| 2012/0279720 | A1 * | 11/2012 | Whitby et al. | 166/363 |
| 2013/0153242 | A1 * | 6/2013 | Flight et al. | 166/363 |
| 2013/0333894 | A1 * | 12/2013 | Geiger et al. | 166/336 |
| 2013/0343928 | A1 * | 12/2013 | McCarthy | 417/379 |

* cited by examiner

METHOD FOR INCREASING SUBSEA ACCUMULATOR VOLUME

TECHNICAL FIELD

This invention relates to the general subject of providing for the flow of fluids in a subsea environment in which volumes are required to be stored under pressure in bottles as a ready reserve and are needed to be deployed to operate low pressure functions, high pressure functions, and functions which require low pressure at one time and high pressure at another time.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The field of this invention is that of providing fluid power to operate subsea components such as the shear rams of subsea blowout preventers and similar components. These components typically make up what is called a subsea blowout preventer stack and have a high volume requirement to operate an appropriate number of these functions. It can range up to 200 gallons of accumulated capacity necessary to operate various blowout preventers and valves on a subsea blowout preventer stack. In many cases such as with shear rams the pressure required to stroke the shear rams to the point of contacting the pipe to be sheared is relatively low (i.e. 500 p.s.i.) and then the force required to shear the pipe is relatively high (i.e. 5000 p.s.i.).

This is further complicated by the fact that an accumulator typically pressurizes the fluid by having compressed gas such as nitrogen provide pressure on the fluid. The compressibility of the gas allows a substantial volume of fluid to be pressurized and then discharged under pressure. A disadvantage of this is that as the liquid is discharged from the accumulator, the volume of the gas becomes larger and therefore the pressure of the gas and liquid becomes lower. As the pistons and rams of the blowout preventer move forward and need higher pressure to do their functions, the pressure of the powering fluid becomes lower. This has typically meant that the lowest pressure from the accumulator must exceed the highest operational pressure of the system. The highest pressure of the accumulator to make this work is simply higher. When a higher pressure is provided by the accumulator than is needed, it is simply throttled to reduce the pressure and turn the energy into heat.

This has been the nature of the operations of subsea accumulators for the past 50 years. There has been a long felt need for more accumulator volume capacity and the only way that those skilled in the art have met the challenge is with larger and higher pressure accumulators.

BRIEF SUMMARY OF THE INVENTION

The object of this invention is to provide an accumulator system which provides a relatively lower pressure at the start of the stroke of an operated device and a relatively higher pressure at the end of the stroke of an operated device.

A second object of this invention is to provide a system which fully utilizes the stored energy of an accumulator rather than throttling the pressure and discarding the energy as wasted heat.

A third object of this invention is to provide fluid flow at the pressure which is required by the operated function.

DETAILED DESCRIPTION OF THE INVENTION

Figure 1:
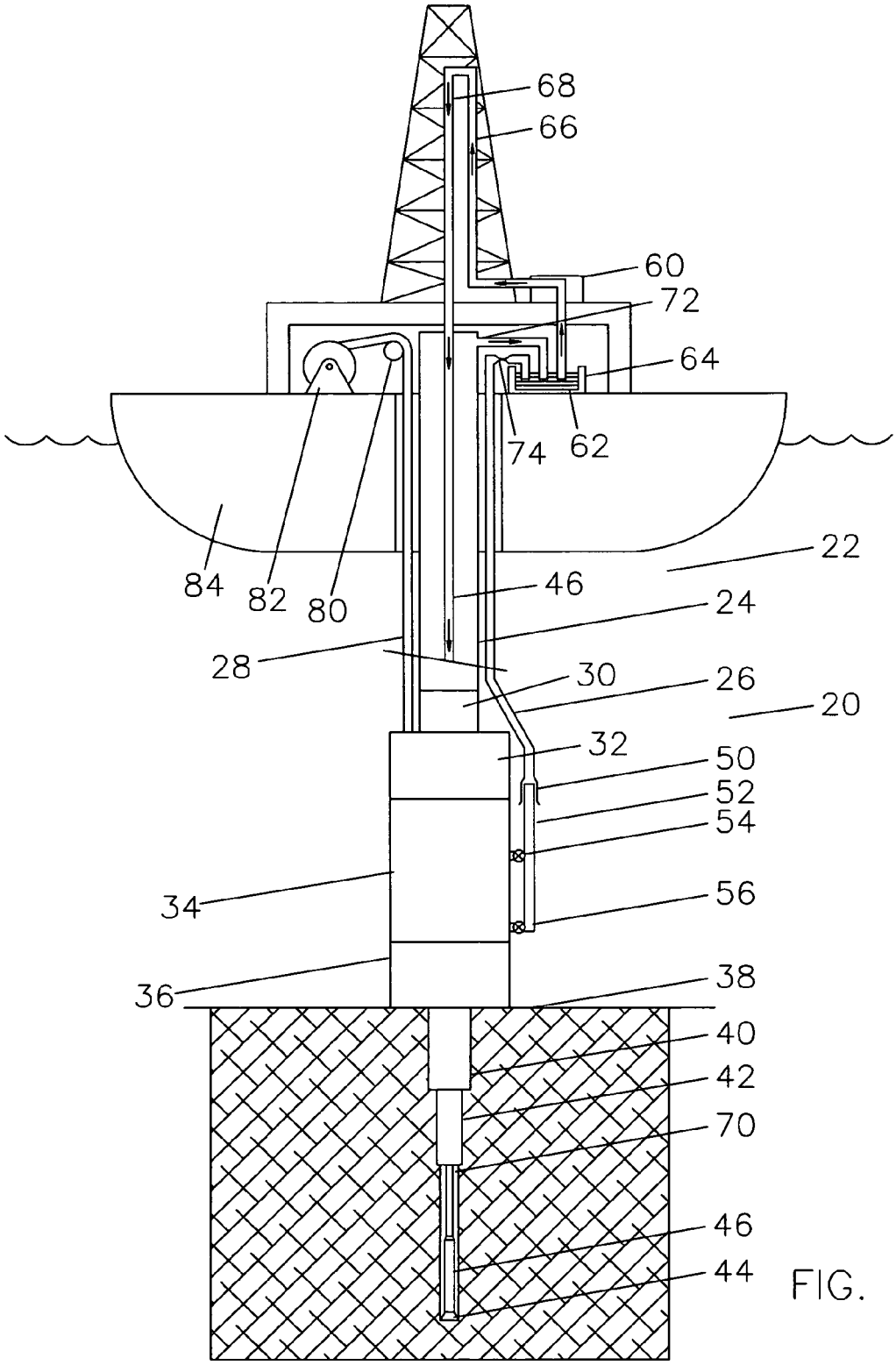
FIG. 1 is a view of a deepwater drilling system such as would use this invention.

Referring now to FIG. 1, a view of a complete system for drilling subsea wells 20 is shown in order to illustrate the utility of the present invention. The drilling riser 22 is shown with a central pipe 24, outside fluid lines 26, and cables or hoses 28.

Below the drilling riser 22 is a flex joint 30, lower marine riser package 32, lower blowout preventer stack 34 and wellhead 36 landed on the seafloor 38.

Below the wellhead 36, it can be seen that a hole was drilled for a first casing string 40, that first casing string 40 was landed and cemented in place, a hole drilled through the first string for a second string, the second string 42 cemented in place, and a hole is being drilled for a third casing string by drill bit 44 on drill string 46.

The lower Blowout Preventer stack 34 generally comprises a lower hydraulic connector for connecting to the subsea wellhead system 36, usually 4 or 5 ram style Blowout Preventers, an annular preventer, and an upper mandrel for connection by the connector on the lower marine riser package 32, which are not individually shown but are well known in the art.

Below outside fluid line 26 is a choke and kill (C&K) connector 50 and a pipe 52 which is generally illustrative of a choke or kill line. Pipe 52 goes down to valves 54 and 56 which provide flow to or from the central bore of the blowout preventer stack as may be appropriate from time to time. Typically a kill line will enter the bore of the Blowout Preventers below the lowest ram and has the general function of pumping heavy fluid to the well to overburden the pressure in the bore or to "kill" the pressure. The general implication of this is that the heavier mud cannot be circulated into the well bore, but rather must be forced into the formations. A choke line will typically enter the well bore above the lowest ram and is generally intended to allow circulation in order to circulate heavier mud into the well to regain pressure control of the well. Normal circulation is down the drill string 46, through the drill bit 44.

In normal drilling circulation the mud pumps 60 take drilling mud 62 from tank 64. The drilling mud will be pumped up a standpipe 66 and down the upper end 68 of the drill string 46. It will be pumped down the drill string 46, out the drill bit 44, and return up the annular area 70 between the outside of the drill string 46 and the bore of the hole being drilled, up the bore of the casing 42, through the subsea wellhead system 36, the lower blowout preventer stack 34, the lower marine riser package 32, up the drilling riser 22, out a bell nipple 72 and back into the mud tank 64.

During situations in which an abnormally high pressure from the formation has entered the well bore, the thin walled central pipe 24 is typically not able to withstand the pressures involved. Rather than making the wall thickness of the relatively large bore drilling riser thick enough to withstand the pressure, the flow is diverted to a choke line or outside fluid line 26. It is more economic to have a relatively thick wall in a small pipe to withstand the higher pressures than to have the proportionately thick wall in the larger riser pipe.

When higher pressures are to be contained, one of the annular or ram Blowout Preventers are closed around the drill pipe and the flow coming up the annular area around the drill pipe is diverted out through choke valve 54 into the pipe 52. The flow passes up through C&K connector 50, up pipe 26 which is attached to the outer diameter of the central pipe 24, through choking means illustrated at 74, and back into the mud tanks 64.

On the opposite side of the drilling riser 22 is shown a cable or hose 28 coming across a sheave 80 from a reel 82 on the vessel 84. The cable or hose 28 is shown characteristically entering the top of the lower marine riser package. These cables typically carry hydraulic, electrical, multiplex electrical, or fiber optic signals. Typically there are at least two of these systems for redundancy, which are characteristically painted yellow and blue. As the cables or hoses 28 enter the top of the lower marine riser package 32, they typically enter the top of a control pod to deliver their supply or signals. Hydraulic supply is delivered to a series of accumulators located on the lower marine riser package 32 or the lower Blowout Preventer stack 34 to store hydraulic fluid under pressure until needed.

Figure 2:
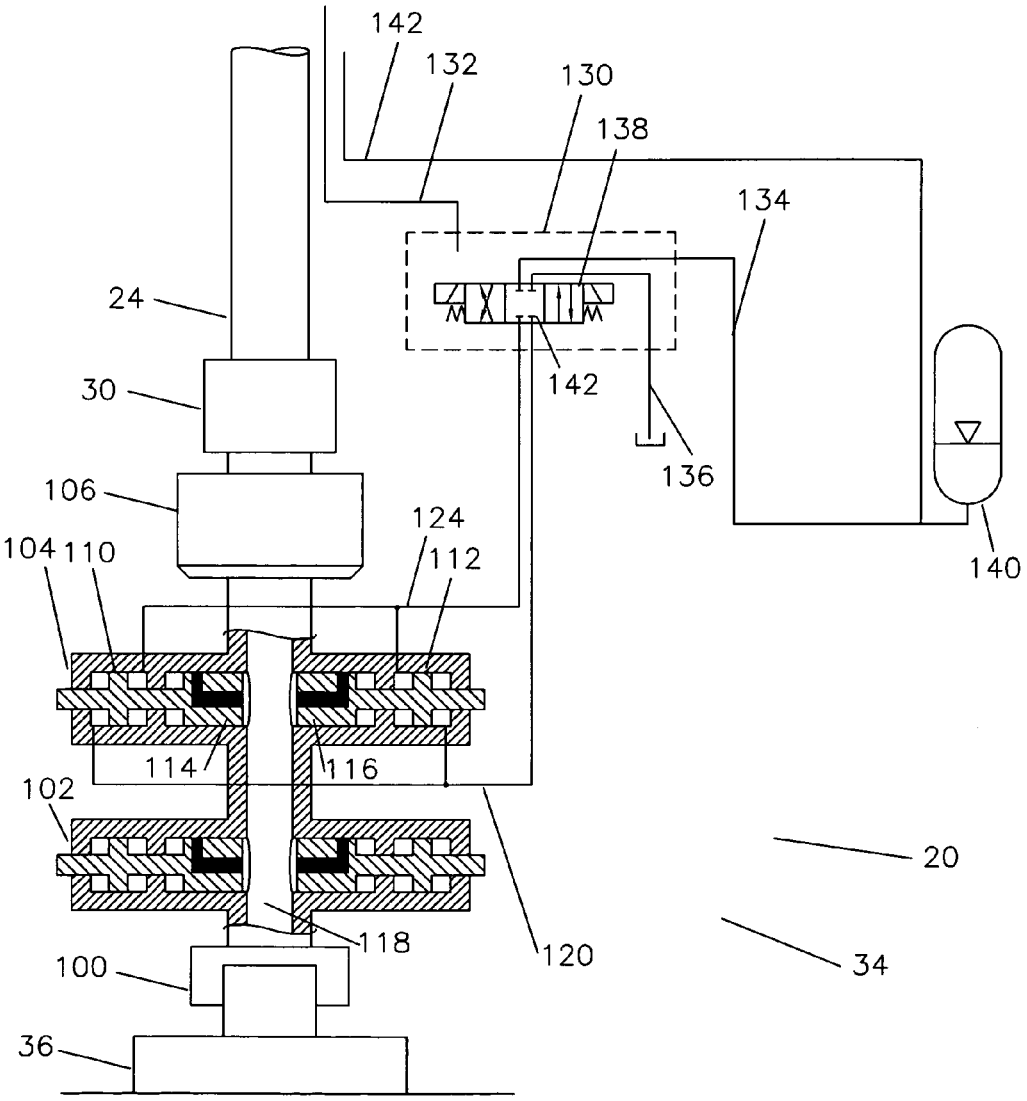
FIG. 2 is a partial section of a blowout preventer stack showing conventional operation.

Referring now to FIG. 2, a partial section of several parts of the conventional state of the art system for drilling subsea wells is shown including a wellhead connector 100, ram type blowout preventers 102 and 104, annular blowout preventer 106, flex joint 30, and drilling riser central pipe 24.

Ram type blowout preventer 104 has pistons 110 and 112 which move rams 114 and 116 into central bore 118. Fluid flow into line 120 will move the pistons and rams forward to seal off bore 118 with return flow going out line 124. Fluid flow into line 124 will move the pistons and rams out off bore 118 with return flow going out line 120.

Control pod 130 receives electric and communication signals from the surface along line 132 and receives hydraulic supply from line 134, and exhausts hydraulic fluid to sea along line 136. Accumulator 140 receives pressurized hydraulic supply from the surface along line 142 and supplies the control pod 130 when appropriate. Electro-hydraulic valve 138 receives hydraulic supply from accumulator 140 and directs the hydraulic supply to open or close the rams of blowout preventer 104

Figure 3:
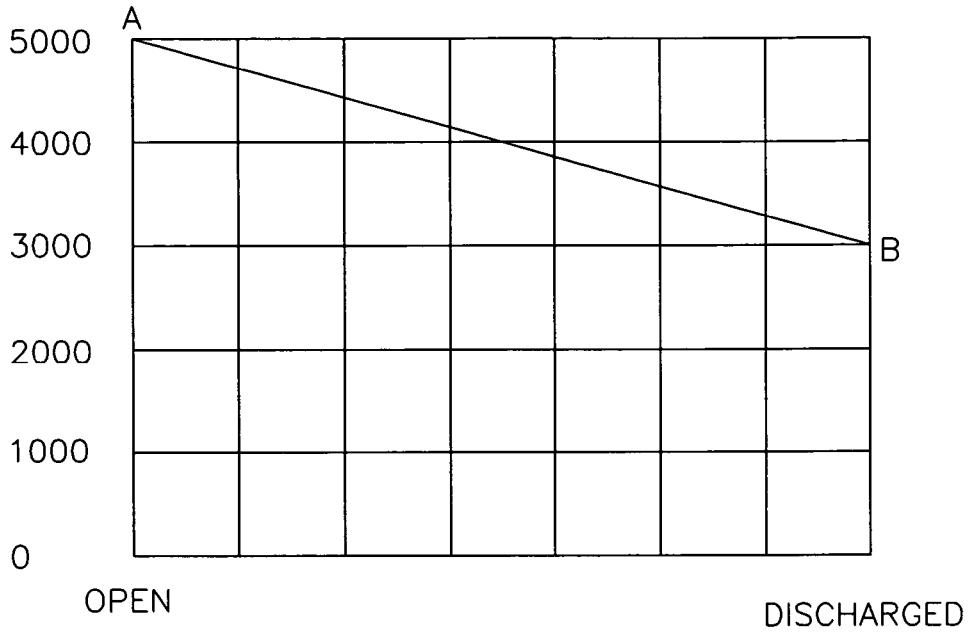
FIG. 3 is a schematic showing the conventional pressure decline of an accumulator as the fluid is discharged.

Referring now to FIG. 3, a graph is shown for fluid which might be coming out of an accumulator such as is shown at 140. For understanding, this graph presumes that the accumulator will go from fully charged to fully discharged when moving one function from open (fully charged) to closed (discharged) as shown by line AB. In reality an accumulator might operate several functions, or several accumulators can be required to operate one function.

Figure 4:
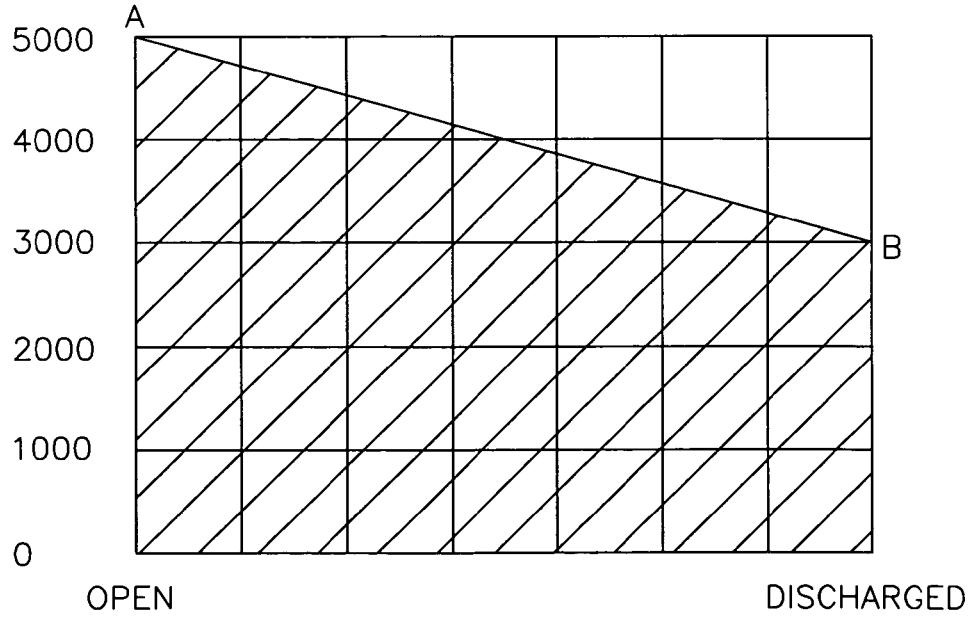
FIG. 4 is a schematic showing the conventional pressure decline of an accumulator as the fluid is discharged with the area below the graphed line cross hatched to illustrate the energy expended.

Referring now to FIG. 4, the area under line AB is cross hatched. As the energy expended from an accumulator is proportionate to the product of the volume times the pressure, the cross hatched area is generally an indication of the amount of energy of the accumulator.

Figure 5:
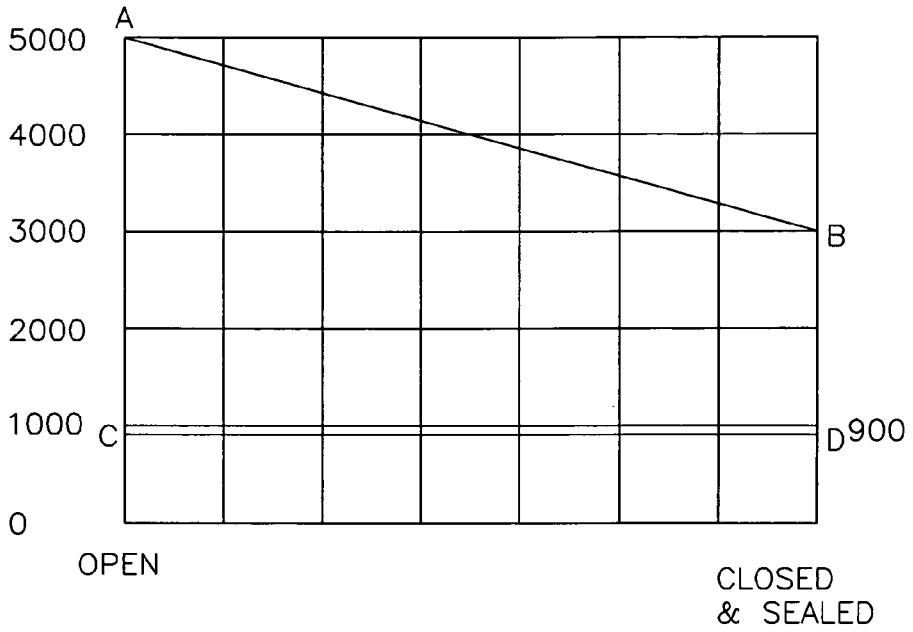
FIG. 5 is the schematic of FIG. 3 with an added line indicating the actual pressure requirement of a function to be operated.

Referring now to FIG. 5, line CD indicates the actual flow and pressure which could be utilized to close a function. It generally indicates that 900 p.s.i. will close it, but the entire volume of the accumulator is required.

Figure 6:
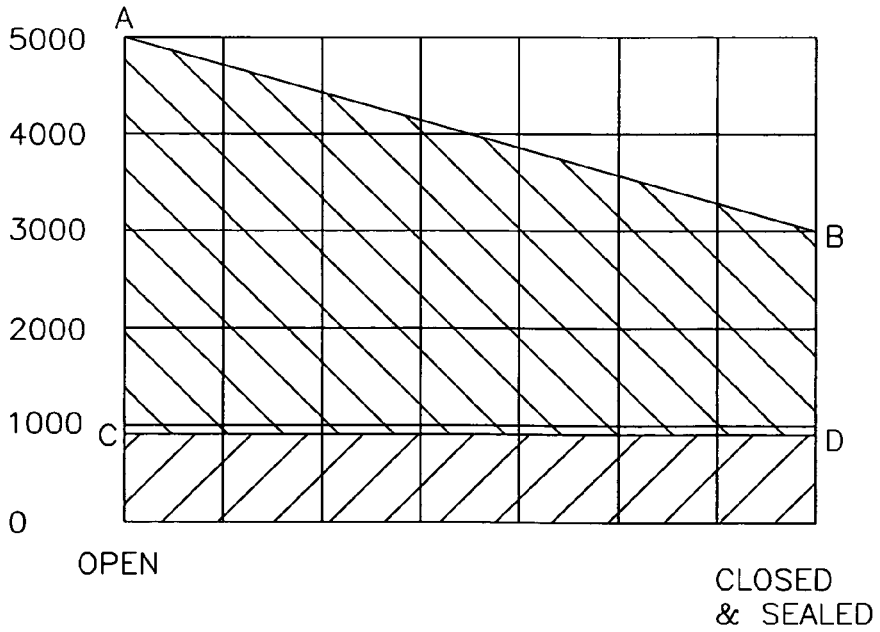
FIG. 6 is the schematic of FIG. 5 with the utilized and wasted energy cross hatched.

Referring now to FIG. 6, the area below line CD is proportionate to the utilized energy in closing the function and the cross hatched area between lines AB and CD is wasted energy. This energy in excess of the required amount will be burned up in faster than required operations and resultant line flow friction losses. This generally indicates that 25% of the energy was used and 75% of the energy was wasted.

Figure 7:
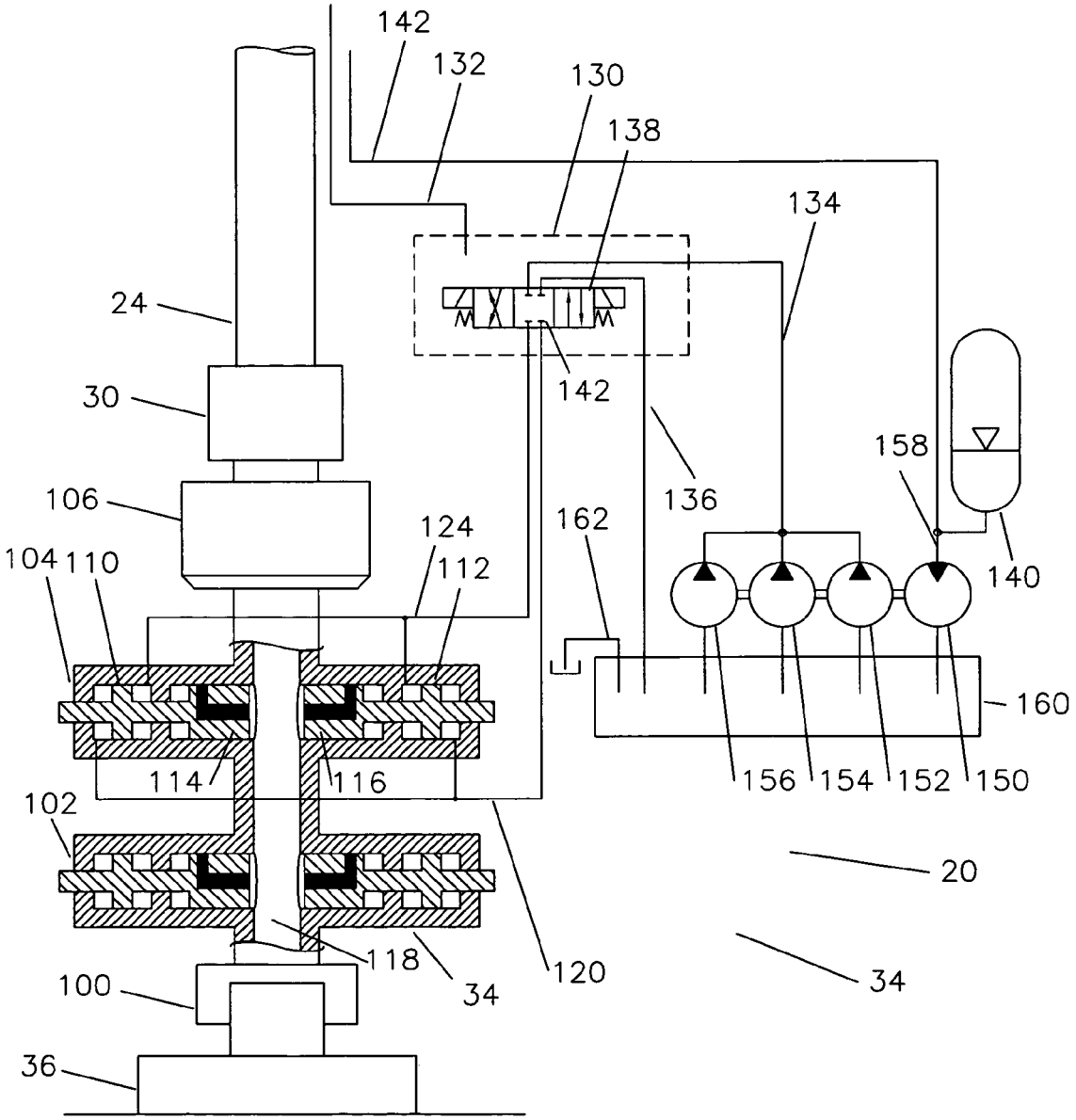
FIG. 7 is a partial section of a blowout preventer stack showing pumps and motors arranged according to the method of this invention in a simple form.

Referring now to FIG. 7, the output of accumulator is not directed to control valve but rather to motor 150. Motor 150 output torque is directed to drive pumps 152, 154, and 156, all of which have the same volume displacement for the purpose of this example. As line 134 required 900 p.s.i. in the example of FIGS. 5 and 6, line 158 will require 3*900=2700 p.s.i. to drive the motors, which is readily available from the accumulator 140. Low pressure tank 160 is provided to collect the returns from control valve 138 such that when 3 times as much is drawn from tank 160 by pumps 152, 154, and 156 as is put into tank by motor 150, standard control fluid will be available. As control valve 138 exhausts into tank 160, excess flow will be vented to sea through line 162.

Figure 8:
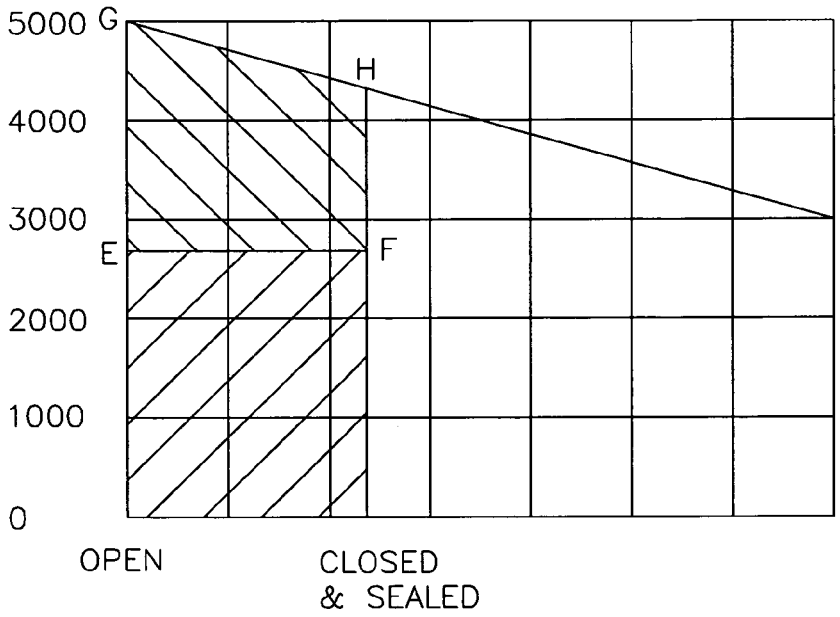
FIG. 8 is a schematic illustrating how much energy can be saved when operating the function illustrated in FIG. 5.
Figure 9:
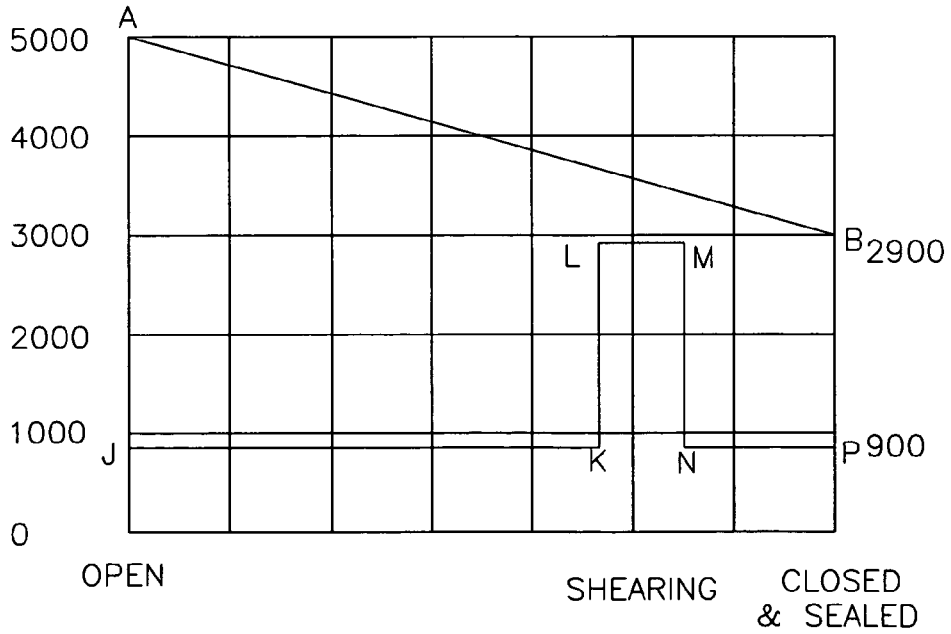
FIG. 9 is a schematic illustrating the pressure requirement of a function such as shearing pipe which has a portion of the stroke actually requiring high pressure.

Referring now to FIG. 8, this is shown graphically. On the X scale is can be seen that only ⅓ of the volume of the accumulator was expended, and the Y scale shows that it was expended at 3 times the pressure, for the same cross hatched area below line EF. The wasted energy between lines EF and GH is less than ¼ of the wasted energy as seen in FIG. 6 to do the same job. Referring now to FIG. 9, line JKLMNP indicates a special operation such as a shear ram on a subsea blowout preventer stack in which a higher pressure is actually needed. In this case as the pistons moved from J to K, the same 900 p.s.i. was required as was in the prior figures. When the shearing of the steel pipe was being done, 2900 p.s.i. as shown in line segment LM was required. After the shearing was accomplished, only 900 p.s.i. was required to continue moving to the sealing position as shown line segment NP.

Figure 10:
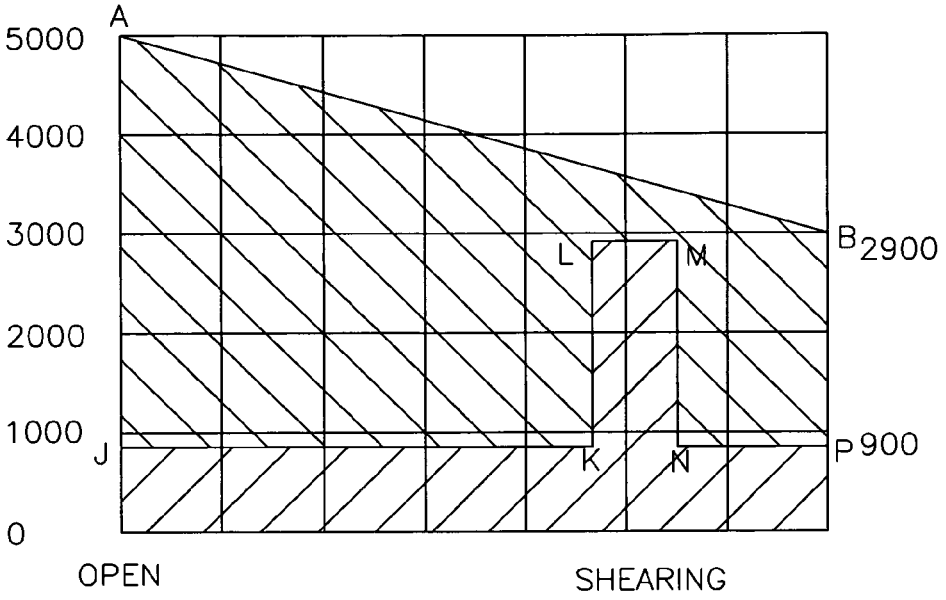
FIG. 10 is the schematic of FIG. 9 with the utilized and wasted energy cross hatched.

Referring now to FIG. 10, it can be seen that the wasted energy between lines JKLMNP and AB is almost as much as was wasted in FIG. 6.

Figure 11:
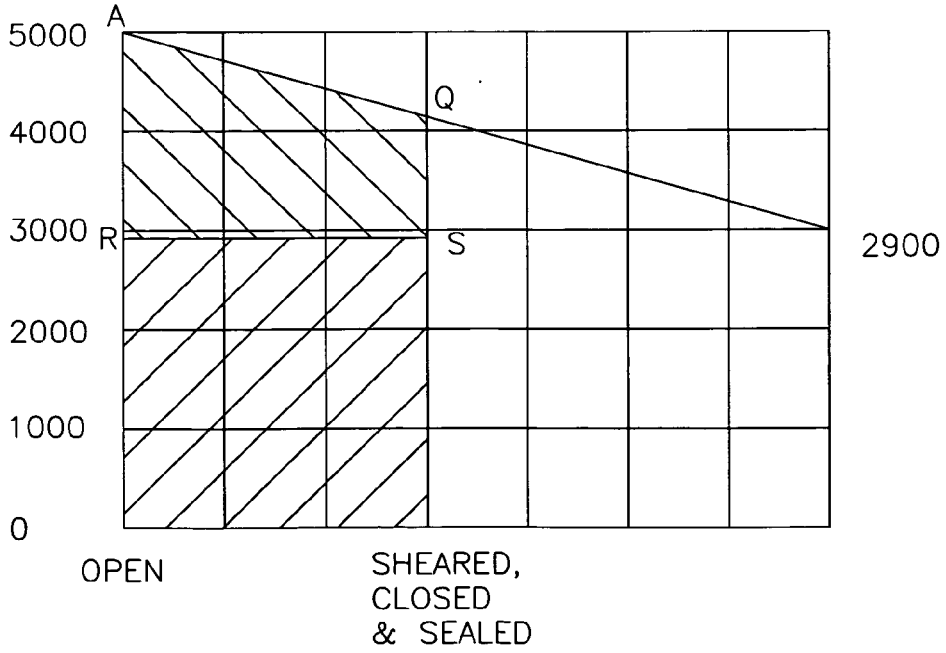
FIG. 11 is a schematic illustrating how much energy can be saved by the present method.

Referring now to FIG. 11, if all the accumulator pressure is expended at the maximum required pressure, we can reduce the required volume by more than 50 percent and substantially reduce the wasted volume as is seen between lines AQ and RS.

Figure 12:
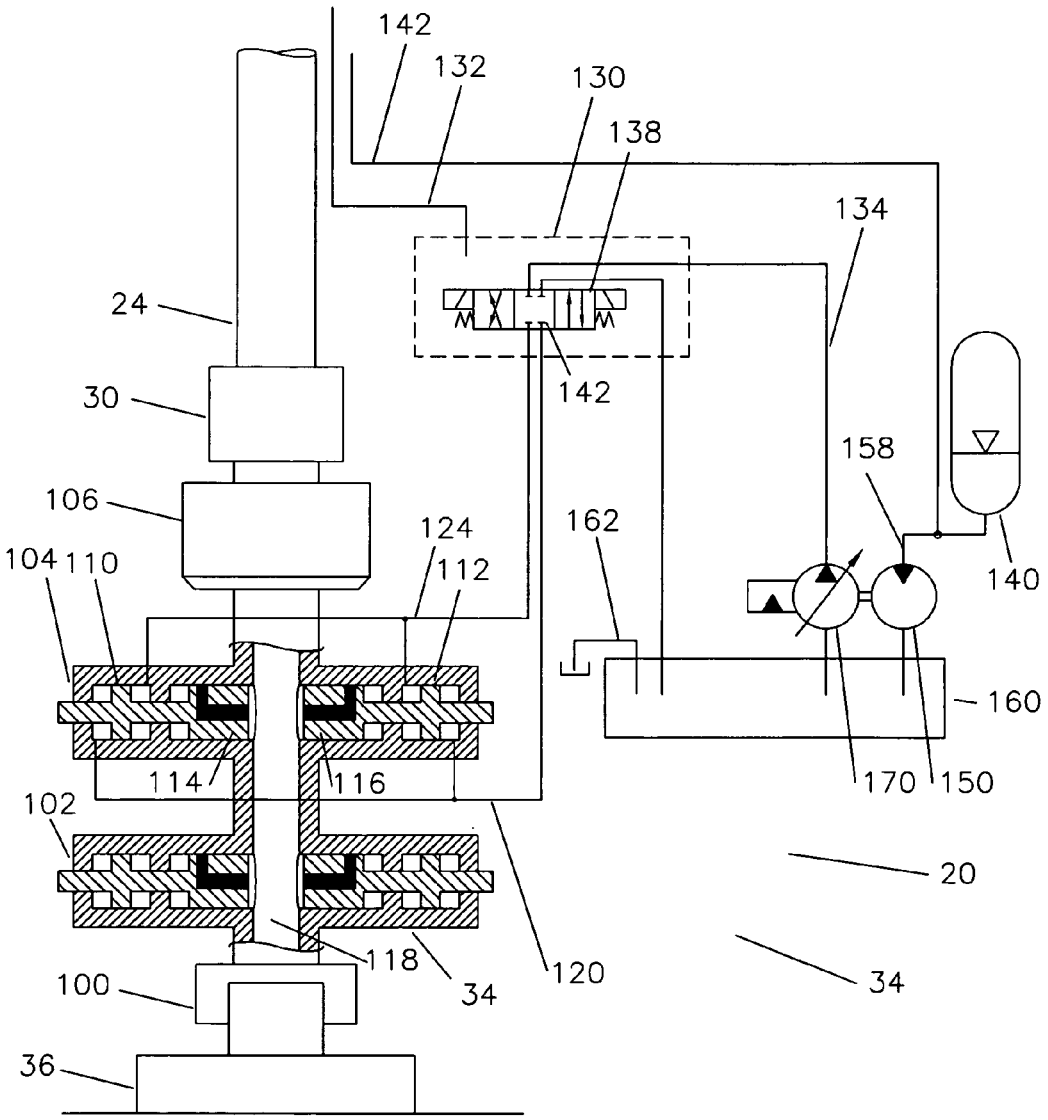
FIG. 12 is a partial section of a blowout preventer stack showing pumps and motors arranged according to the method of this invention in variable displacement form.

Referring now to FIG. 12, the three pumps 152, 154, and 156 of FIG. 7 are replaced by a single pump 170. The pump 170 is a variable displacement pump which is horsepower limited. This means that when the combination of pressure and flow rate (a measure of horsepower) exceeds a maximum, the variable flow rate is lowered until the horsepower setting is not exceeded. In the example of FIGS. 9 and 10, if the horsepower is set to that calculated by the given flow rate times 2900 p.s.i., the pipe will be sheared as was anticipated in FIGS. 9 and 10. At the times when the pipe is not being sheared, the 2900 p.s.i. cannot be achieved in line 134. As a result the variable displacement pump will change the displacement until the increased flow times 900 p.s.i. will equal the original flow time 2900 p.s.i. In this case the flow will need to be adjusted upwardly by (2900/900=3.22) a factor of 3.22/1. As the same volume is actually required to move the pistons and rams, it means that in the non-shearing portion of the stroke, the volume required from the accumulator will be reduced by a factor of 3.22.

Referring back to FIG. 11, it can be seen that the net required volume from the accumulators can be reduced by more than 50%. This means that the size of the required accumulators can be reduced to accomplish the set of required tasks, or that more capability can be provided by the same accumulators.

The same benefit can be obtained if the motor is the variable displacement device and the pumps are fixed displacement. The volume output of the pumps is generally inversely proportionate to the required pressure to operate the device to be operated.

The previous examples have shown how to increase the flow volume from an accumulator to an operated device. Alternately, the flow to the device can be decreased in order to achieve a higher pressure.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. A method of providing a flow of pressurized fluid from a subsea accumulator to operate a subsea blowout preventer stack having at least one ram blowout preventer, comprising:

discharging the subsea accumulator to drive one or more motors, driving one or more variable displacement pumps by said one or more motors, varying the displacement of said one or more variable displacement pumps to provide a flow rate which is inversely proportionate to a pressure required to operate said subsea blowout preventer stack having at least one ram blowout preventer and wherein the pressure to operate the at least one ram blowout preventer is lower at a start of a stroke and the pressure to operate the at least one ram blowout preventer is higher at an end of the stroke of the at least one ram blowout preventer whereby the pressurized fluid from the subsea accumulator is fully utilized rather than throttled and discarded.

2. The method of claim 1, further comprising said variable displacement of said one or more variable displacement pumps is generally a function of the inverse of an output pressure of said one or more variable displacement pumps.

3. The method of claim 2, further comprising said one or more motors is variable displacement.

4. The method of claim 3, further comprising said variable displacement of said variable displacement of said one or more motors is generally an inverse function of an output pressure of said one or more motors.

* * * * *